US010443908B2

(12) United States Patent
Kawasaki

(10) Patent No.: US 10,443,908 B2
(45) Date of Patent: Oct. 15, 2019

(54) BEVERAGE COOLER OR WARMING APPARATUS

(71) Applicant: Cy Kawasaki, Renton, WA (US)

(72) Inventor: Cy Kawasaki, Renton, WA (US)

( * ) Notice: Subject to any disclaimer, the term of this patent is extended or adjusted under 35 U.S.C. 154(b) by 0 days.

(21) Appl. No.: 15/498,345

(22) Filed: Apr. 26, 2017

(65) Prior Publication Data

US 2018/0313583 A1 Nov. 1, 2018

(51) Int. Cl.

| | |
|---|---|
| ***F25B 21/02*** | (2006.01) |
| ***F25B 21/04*** | (2006.01) |
| ***F25D 3/06*** | (2006.01) |
| ***A47G 23/03*** | (2006.01) |
| ***F25D 31/00*** | (2006.01) |

(52) U.S. Cl.

CPC ..... *F25B 21/04* (2013.01); *F25D 31/007* (2013.01); *F25B 2321/0211* (2013.01); *F25B 2321/0251* (2013.01); *F25D 2331/805* (2013.01)

(58) Field of Classification Search

CPC ..... F25B 21/02; F25B 21/04; F25B 2321/02; F25B 2321/021; F25B 2321/0211; F25B 2321/0212; F25B 2321/023; F25B 2321/025; H05K 2201/10219; A47G 23/03; B60N 3/10; B60N 3/101; B60N 3/102; A47C 7/68; A47F 3/0491; F25D 3/06; F25D 3/08; F25D 31/002; F25D 31/006; F25D 31/007; F25D 31/008

See application file for complete search history.

(56) References Cited

U.S. PATENT DOCUMENTS

| | | | | |
|---|---|---|---|---|
| 4,738,113 | A * | 4/1988 | Rudick | F25B 21/02 62/3.5 |
| 4,891,949 | A * | 1/1990 | Caldarola | A23G 9/08 62/3.2 |
| 4,914,920 | A | 4/1990 | Carragie et al. | |
| 5,699,669 | A | 12/1997 | Gebhard | |
| 5,720,171 | A | 2/1998 | Osterhoff et al. | |
| 5,970,179 | A | 10/1999 | Merritt | |
| 5,970,719 | A * | 10/1999 | Merritt | A47J 36/2433 62/3.2 |
| 6,082,114 | A | 7/2000 | Leonoff | |
| 8,887,512 | B2 | 11/2014 | Olsen et al. | |

(Continued)

*Primary Examiner* — Keith M Raymond
*Assistant Examiner* — Erik Mendoza-Wilkenfel
(74) *Attorney, Agent, or Firm* — Dean A. Craine, P.S.

(57) ABSTRACT

A cooling or warming apparatus for beverages that relies primarily on conduction heat transfer. The apparatus includes at least one heat conduction unit inside an enclosed case. The heat conduction unit includes a cylindrical sleeve with a center bore configured to receive and transfer heat to and from a 12 fl. oz. aluminum can or 0.5 liter plastic water bottle. Attached to the outside surface of the sleeve is a laterally extending interface block. Both the sleeve and the interface block are made of aluminum and covered with an insulation layer. A Peltier device planar structure with a cool side and a hot side. During assembly the Peltier device is attached with the cold side in direct contact with the exposed end of the interface block. A heatsink is attached to opposite the hot side of the Peltier device, and a fan assembly mounted is over the heatsink. The apparatus includes control switches that control its operation as a cooling or warming apparatus and a 12 VDC electrical power source.

6 Claims, 22 Drawing Sheets

(56) References Cited

U.S. PATENT DOCUMENTS

| | | | | |
|---|---|---|---|---|
| 9,365,146 | B1 * | 6/2016 | Allen | B60N 3/104 |
| 2004/0140304 | A1 * | 7/2004 | Leyendecker | A47J 36/2433 219/386 |
| 2005/0274119 | A1 * | 12/2005 | Lee | F25B 21/04 62/3.7 |
| 2006/0150637 | A1 * | 7/2006 | Wauters | B67D 1/0462 62/3.64 |
| 2015/0198358 | A1 * | 7/2015 | Jones, Jr. | F25B 21/02 62/3.2 |
| 2016/0209111 | A1 * | 7/2016 | Jafa | F25D 31/007 |

* cited by examiner

BEVERAGE COOLER OR WARMING APPARATUS

COPYRIGHT NOTICE

Notice is given that this patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention relates generally to portable coolers, and more particularly to portable coolers specifically designed for chilling beverages sold in 12 fl. oz. aluminum cans or 16.9 fl. oz. (0.5 L) plastic water bottles.

2. Description of the Related Art

Portable coolers in the prior art use ice, cooling packs or Peltier devices to cool ambient air that directly flows against beverages or other food items inside the cooler or against an intermediate object that holds beverages or food items. Unfortunately, each time the cooler is opened to access the beverages or food item, cold air created inside the cooler escapes and replaced by warm outside ambient air. When the cooler is closed, the warm ambient air must be cooled. Reducing the volume of cold air lost when the cooler is opened is a common approach to making these coolers more efficient.

In the United States, soft drinks are commonly sold in 12 fl. oz. aluminum cans. The U.S. standard aluminum can is 4.83 inches in height, 2.13 inches in diameter at the lid, and 2.60 inches in the diameter at the widest point of the body. Drinking water is commonly sold in 16.9 fl. oz. (0.5 liter) plastic bottles. Although the size of 16.9 fl. oz. water bottles in the U.S. varies more than aluminum cans do, they typically measure approximately 9 inches in height and 2.5 inches in diameter at the widest point of the body. By making aluminum cans and plastic water bottles with nearly identical diameters, the cans and water bottles will fit into standardized cup holders in motor vehicles sold in the U.S.

When traveling in an automobile, it is common for drivers and passengers to drink hot beverages, such a hot coffee, from containers also designed to fit into standardized cup holders in a motor vehicle.

What is needed is a compact, lightweight, quiet, cooler for one or two standard size 12 fl. oz. aluminum cans or 16.9 fl. oz. plastic water bottles. What is also needed is such a cooler that does not rely on cooling ambient air but instead uses more efficient conduction heat transfer processes. What is also needed is a cooler that can also be a warmer for beverages when desired.

SUMMARY OF THE INVENTION

These and other objects of the invention are met by the beverage cooling or warming apparatus that includes at least one heat conduction unit inside a compact, lightweight case. Each heat conduction unit includes at a cylindrical sleeve with a center bore configured to receive a beverage container, a laterally extending interface block attached to the cylindrical sleeve, and a Peltier device (also called a 'thermoelectric heat pump') attached to the interface block.

The cylindrical sleeve's center bore is configured to receive and transfer heat to and from either a standard 12 fl. oz. aluminum can, a 16.9 fl. oz. plastic water bottle or a complimentary-shaped, heat transferring secondary container. In one embodiment, the center bore is 1 to 2 mm larger in diameter than a standard 12 fl. oz. aluminum beverage can and 2 to 4 mm larger in diameter than a plastic water bottle as defined above. The length of the center bore is approximately 6 inches which is optimal for use with a 4.8 inch tall aluminum can or a 9 inch tall plastic water bottle. When a cylindrical sleeve is used that is longer than an aluminum can, a chair is placed inside the center bore to elevate the beverage can inside the cylindrical sleeve so the top lid of the beverage can is exposed enabling the beverage can to be easily grasped. When used with a water bottle, approximately ⅔ length of a water bottle is positioned inside the cylindrical sleeve. It should be understood that the length of the cylindrical sleeve may vary 1.5 inches in length.

The Peltier device is a thin, thermoelectric cooling plate with two opposite, heat absorbing (cooling) or heat generating (warming) planar sides. Which planar side of the Peltier device is heat absorbing or heat generating depends on the direction of current flow. The Peltier device is aligned so that one planar side is in direct contact with the interface block. A heatsink is attached to the opposite planar side of the Peltier device. A fan assembly is mounted over the heat sink.

Disposed around the cylindrical sleeve and the interface block is relatively thick, insulation layer. In the embodiment described and shown herein, the insulation layer is made of polyurethane adhesive tape wrapped completely around the exposed outer surfaces of the cylindrical sleeve and the interface block.

In the embodiment shown, the cooler includes a compact case with two heat conduction units arranged in a side-by-side manner with their axes aligned parallel. The case includes a top roof through which the two cylindrical sleeves extend. Attached to the case is a pivoting lid that covers the top roof pivots and selectively opens enabling the user to access the aluminum cans, the water bottles or the secondary container. Because the cylindrical sleeve and interface block are covered with an insulation layer and located inside the interior cavity below the top roof, impact of ambient air that enters the case when the lid is opened is minimal.

Air vents are formed on the case that allow ambient air to freely flow into the interior cavity. The fan assembly causes the ambient air to flow over the heatsink so the heat differential is maintained between the cold and hot planar sides of the Peltier device.

The cooler also includes a main ON/OFF control switch, a single Cold or Hot control switch, and a LO to HIGH variable switch. The cooler is also distributed with a motor vehicle 12 VDC power plug that connects directly to the cooler and/or with a 110 VAC electrical adapter that converts 110 VAC to 12 VDC.

When the apparatus is a warmer, a heat transferring, cylindrical shape, secondary container must be used in each cylindrical sleeve. The diameter of the secondary container is equal or slightly less than (1-3 mm) the 12 fl. oz. aluminum can or plastic water bottle as described above.

During use, the user decides if the apparatus is to be a cooler or warmer. The user then adjusts the Cold or Hot control switch to the desired operation. The user then adjusts the LO to HIGH variable switch to control the amount of cooling or heating desired. Next, the user then places the designed aluminum can, water bottle or secondary container in one or both cylindrical sleeves. After 60 to 90 minutes, the beverage or water in the aluminum can, water bottle or secondary container should be at the desired temperature.

DESCRIPTION OF THE PREFERRED EMBODIMENT(S)

Referring to the Figs. there is shown a portable beverage carrier apparatus 10 that includes a case 12 with an enclosed cavity 14 with two energy heat conduction units, 100, 100' mounted therein.

Figure 11:
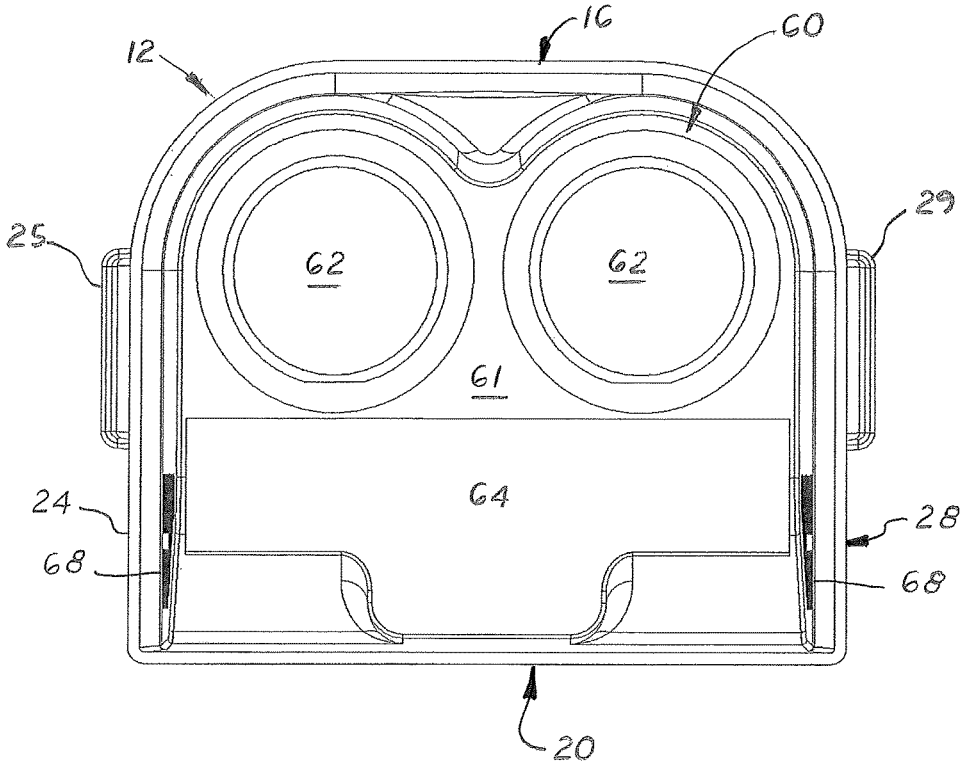
FIG. 11 is a top plan view of the apparatus with the lid removed and showing the top roof.

As shown in FIGS. 1-7, the case 12 is a small, compact structure specifically designed to house two heat conduction units 100, 100'. The case 12 includes a front wall 16, a rear wall 20, a left side wall 24, a right side wall 28, and a top roof 60. Formed on the case 12 is a bottom opening 36, shown more clearly in FIG. 11. During assembly, a base 40 is attached over the bottom opening 36. When the top roof 60 is attached to the case 12, an enclosed interior cavity 14 is formed inside the case 12 surrounded by the front wall 16, the rear wall 20, the left side wall 24, the right side wall 28, and the top roof 60. As described further below, attached to the case 12 and extending over the top roof 60 is an optional pivoting lid 80.

The base 40 includes main body 42 with a perimeter edge 43 complimentary to the outline shape of the front, rear and side walls of the case 12. The main body 42 includes a perpendicularly aligned raised abutment edge 44 located inside the main body's perimeter edge 43. During assembly, the abutment edge 44 extends into the case's bottom opening 36 and adjacent to the front wall 16, the rear wall 20 and the left and right side walls 24, 28, respectively, to provide structural support.

Perpendicularly aligned and mounted or formed on the inside surface of the base 40 are two necks 46 each designed to engage the lower end of a cylindrical sleeve 110. During use, the two necks 46 which are slightly larger than the cylindrical sleeve 110, to hold the lower ends of the cylindrical sleeves 110 in a fixed position on the base 40. Each neck 46 includes a rear extension void area 47 configured to receive the lower end of the protruding mounting surface 114 formed on one side of the cylindrical sleeve 110. During assembly, an optional end cap 112 is attached to the lower edge of the cylindrical sleeve 110 to form a watertight fitting inside the cylindrical sleeve 110, (see FIG. 17).

Also formed on the base 40 are plurality of air vent openings 50 and a plurality of elevated feet 54. The feet 54 support and raise the base 40 over a support surface allowing outside ambient air to flow freely through the vent openings 50 and into or out of the interior cavity 14 during operation.

Figure 10:
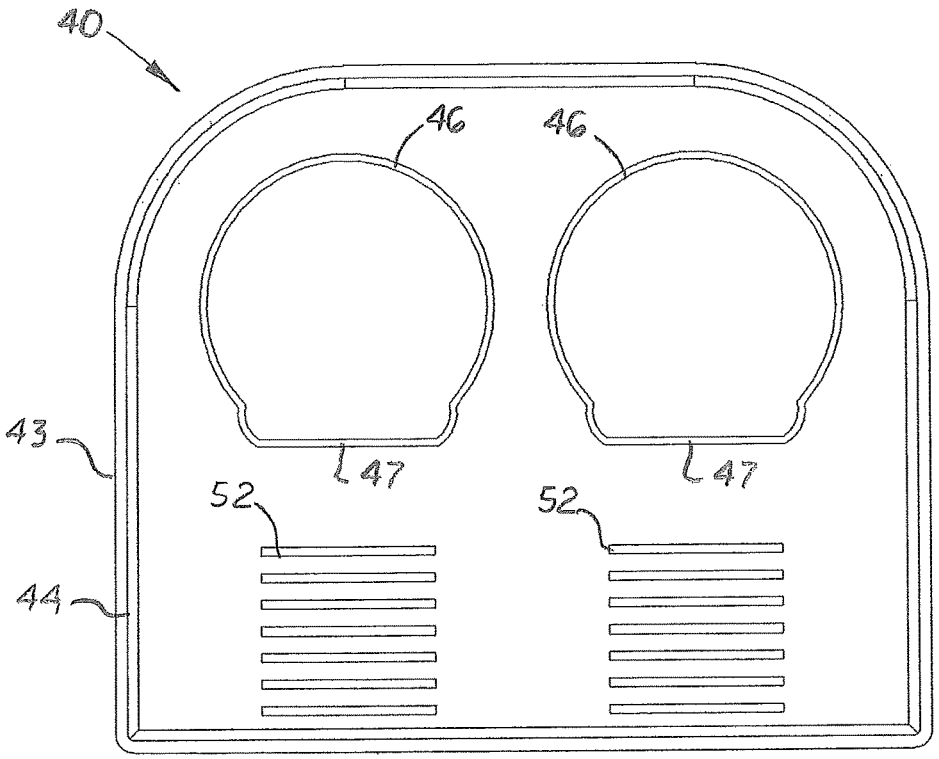
FIG. 10 is a top plan view of the base.
Figure 18:
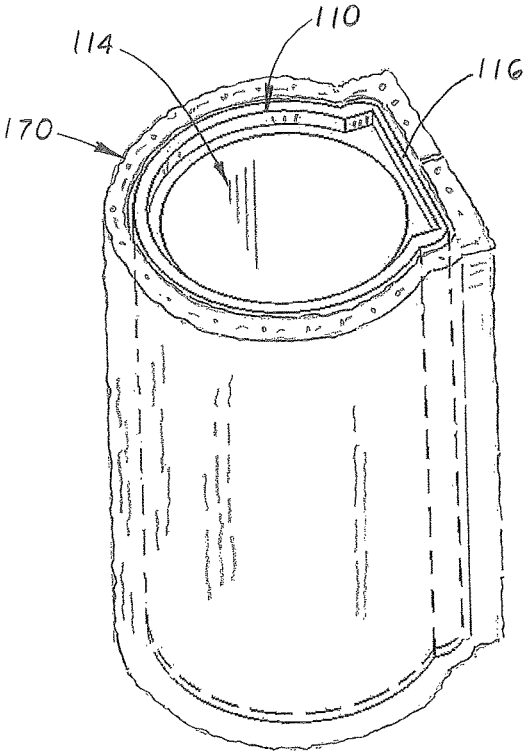
FIG. 18 is a perspective view of the cylindrical sleeve with an insulation layer installed.
Figure 20:
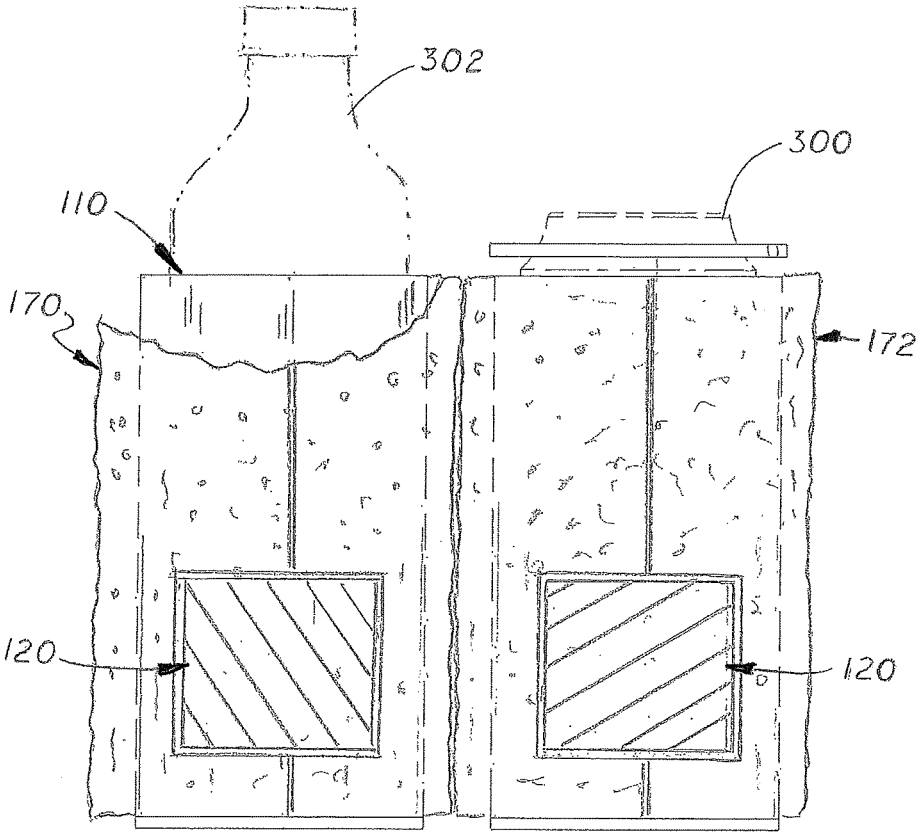
FIG. 20 is a sectional end elevational view of the two side-by-side cylinder sleeves one holding an aluminum can and the other hold a plastic water bottle.

The top roof 60 is integrally formed or attached over the top opening of the case 12 and attaches or is integrally formed with the front wall 16, the rear wall 20, and the left and right side walls 24, 28, respectively. As shown in FIGS. 10 and 18, the top roof 60 includes flat front section 61 with two sleeve openings 62 and a rear section 64. In the embodiment shown in the Figs, the rear section 64 is offset and lower than the front section 61. Formed around each sleeve opening 62 is a coaxially aligned recessed circular race 66 that receives a flat gasket 70 attached to the lid 80. Formed on the rear section 64 is a switch panel 72 that includes a main ON/OFF control switch 73, a single Cold or Hot control switch 74, and a LO to HIGH variable switch 76. It may also include an optional LED bulb 75. (see also FIG. 20).

Figure 12:
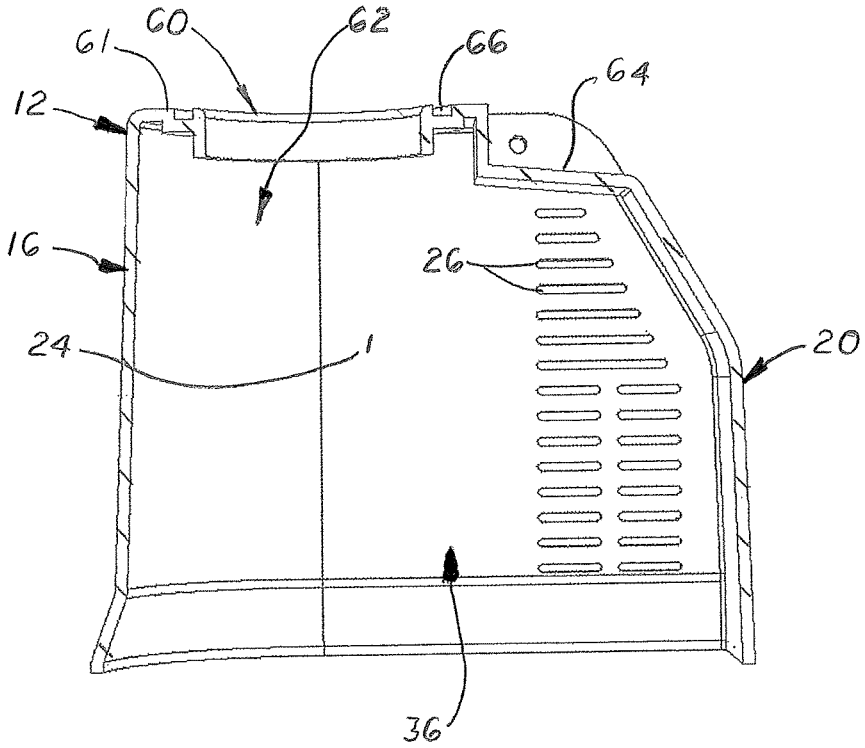
FIG. 12 is a sectional side elevational view of the case.
Figure 13:
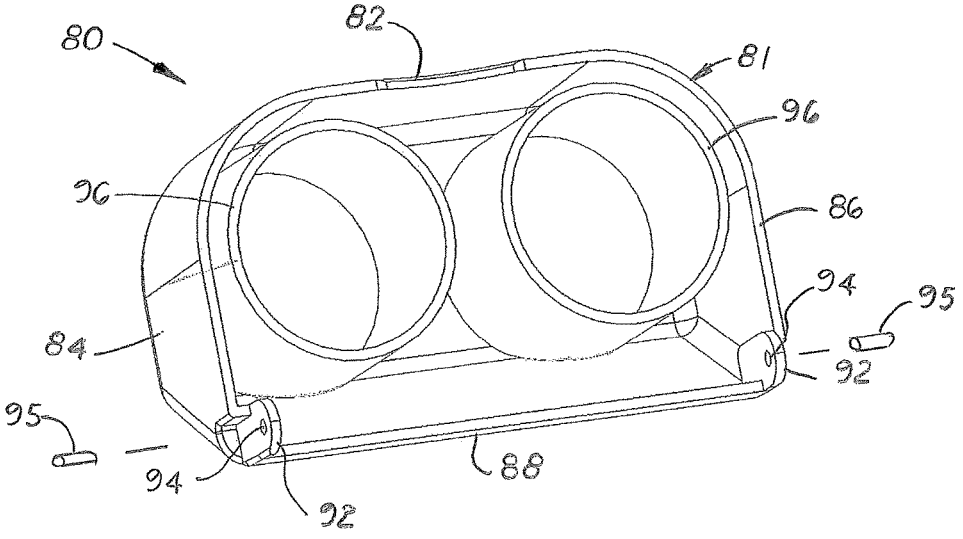
FIG. 13 is a bottom perspective view of the lid.
Figure 14:
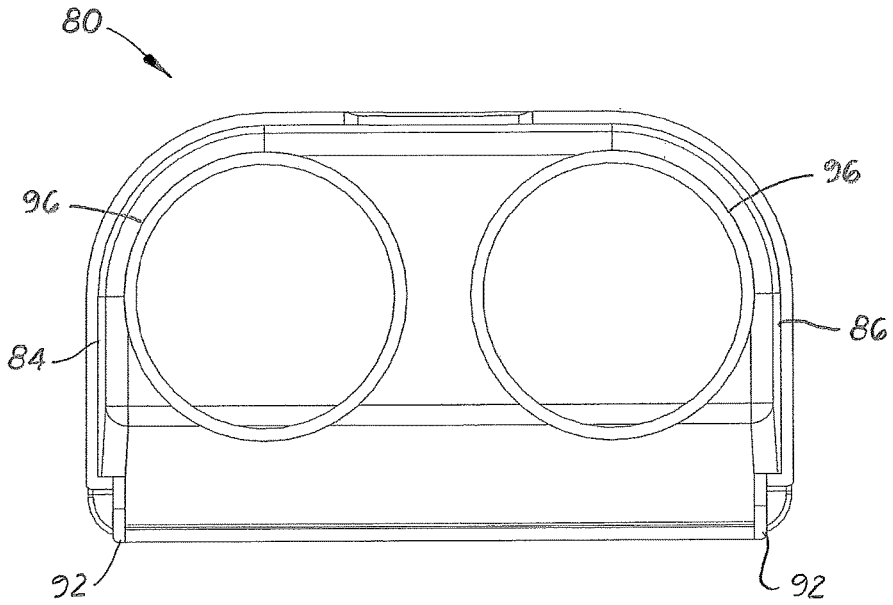
FIG. 14 is a bottom plan view of the lid.
Figure 15:
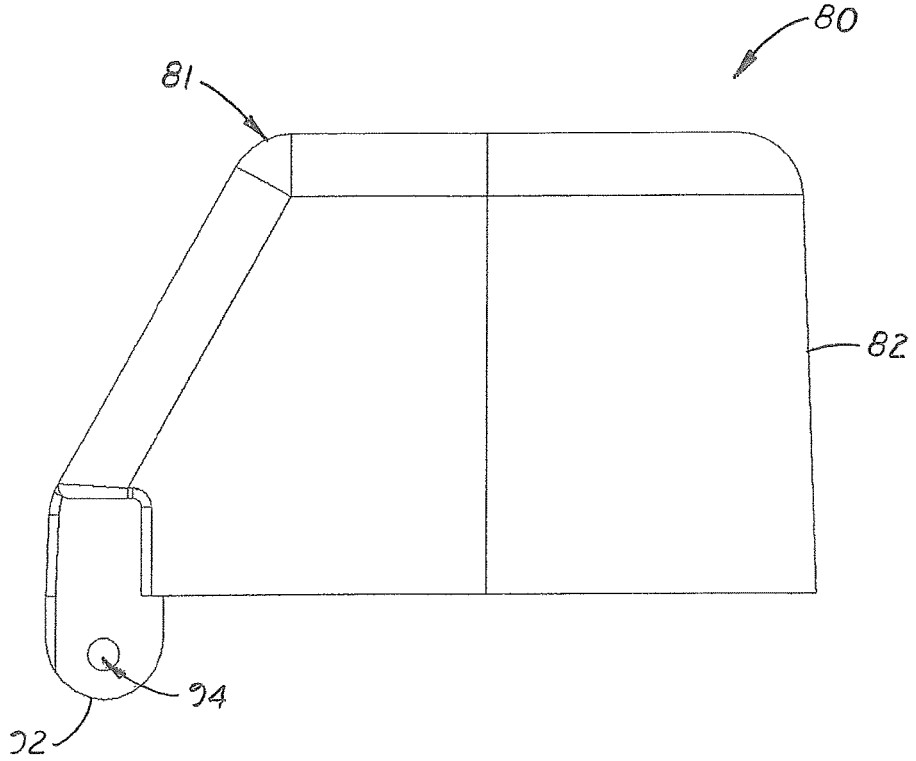
FIG. 15 is a side elevational view of the lid.

The lid 80 includes a lid body 81 with a front wall 82, two side walls 84, 86, a rear wall 88, and a top panel 90. Formed on the opposite corners of the lid body 81 adjacent to the rear wall 20 are two downward extending arms 92. The arms 92 are parallel and fit into complimentary-shaped slots 68 formed on the opposite corners of the top roof 60. As shown in FIG. 12, each arm 92 include a bore 94 that, during assembly, are aligned and registered with bores 26, 27, formed inside the side walls 24, 28, respectively, near the adjacent edges of the top cover 60 and the rear wall 20 when inserted into the slots 68. A peg 95 is inserted into adjacent bores 26, 27, and 94 to lock and pivotally attached the lid body 81 to the case 12.

The lid 80 includes an inside cavity with two perpendicularly aligned cylindrical receivers 96 aligned and registered over the top edges of the two cylindrical sleeves 110 when the lid 80 is closed over the case 12. The cylindrical receivers 96 are perpendicularly aligned to the inside surface of the top panel 90. The cylindrical receivers 96 are aligned so they are longitudinally aligned over the cylindrical sleeves 110 when the lid 80 is closed over the top roof 60. Attached to the lower edges of each cylindrical receiver 96 is a circular flat gasket 97. The cylindrical receivers 96 are configured to receive the top portion of a beverage container when placed into a cylindrical sleeve 110. When the lid 80 is closed, the cylindrical receivers 96 are longitudinally aligned with the cylindrical sleeves 110. The cylindrical receivers 96 are enough in length so that when the lid 80 is closed, the gaskets 97 extend into circular recessed races 66 formed on the top roof 60 and coaxially aligned around each cylindrical sleeve 110. During use, the gaskets 97 fits into the races 66 and presses firmly against the top roof 60 and apply downward pressure on the top roof 60. The gaskets 97 also provide insulation between the lid 80, the top roof 60, and the cylindrical sleeve 110.

The case 12 and lid 80 are made of plastic or sheet metal.

Figure 19:
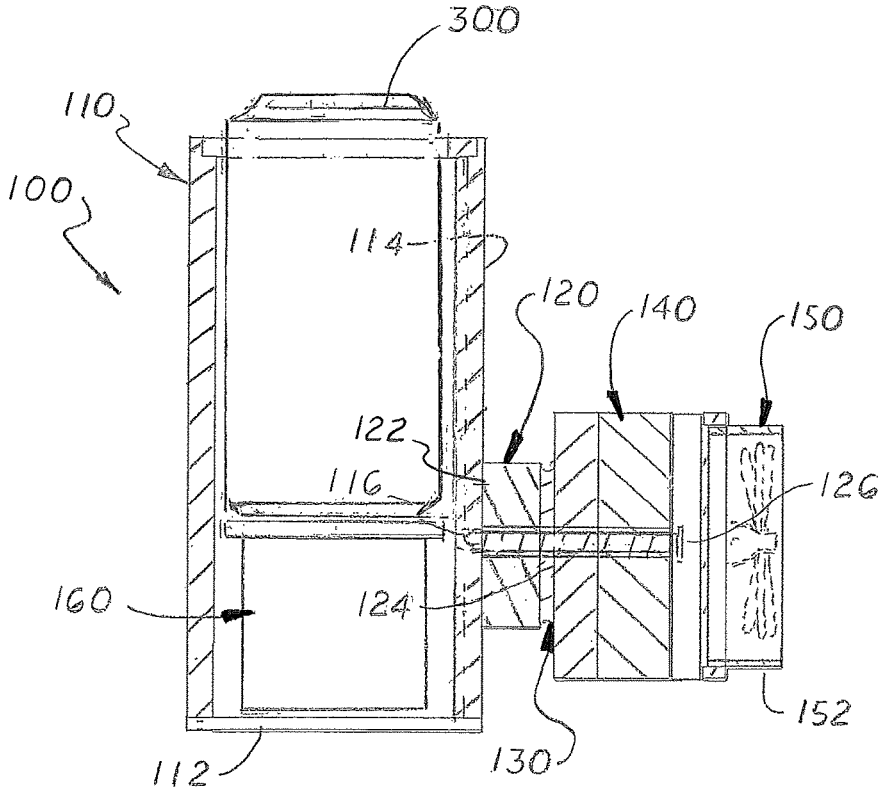
FIG. 19 is a side elevational view of the cylinder sleeve, the interface block, the Peltier device, the heatsink and fan assembly.
Figure 22:
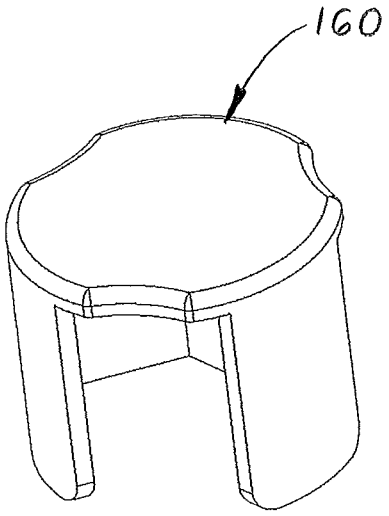
FIG. 22 is a perspective view of a chair.

As shown in FIG. 19, a removable chair 160 may be inserted into the cylindrical sleeve 110 to elevate a standard 12 fl. oz. aluminum beverage can 300. FIG. 22 is a perspective view of the chair 160. In the embodiment shown in FIG. 22, the chair 160 is sufficient in height to elevate the aluminum can 300 so that the upper 10 to 15% of the aluminum can 300 is exposed. When used to cool a water bottle 302, the chair 160 is removed and may be stored in a cylindrical receiver 96 formed on the lid 80.

Located inside the interior cavity 14 is at least one heat conducting unit 100. In the embodiment presented, there are two heat conducting units 100, 100' located inside the interior cavity 114. Each cooling unit 100, 100' includes a cylindrical sleeve 110, an interface block 120, a Peltier device 130, a heatsink 140, a fan 150 and insulation layer 170.

Figure 17:
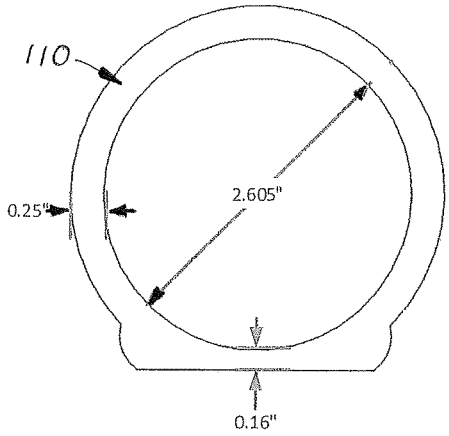
FIG. 17 is a top plan view of a cylindrical sleeve.

The cylindrical sleeve 110 includes a center bore 112 configured to receive and to transfer heat to and from a standard aluminum can 300 that measures approximately 4.8 inches in length or a water bottle 302 that measures approximately 8.5 inches in length. In the embodiment shown and described therein, the length of the cylindrical sleeve 110 is optimized for use with aluminum cans 300 and water bottles 302. The cylindrical sleeve 110 is made aluminum approximately 6 inches in length with an outer diameter that measures approximately 3.105 inches. The center bore 112 is approximately 2.605 inches in diameter. As shown in FIG. 17, the sidewall of the cylindrical sleeve 110 are approximate 0.25 inches thick. The cylindrical sleeve 110 includes a longitudinally aligned flat mounting surface 114 formed on one side for mounting the flat surface 122 of the interface block 120.

Figure 16:
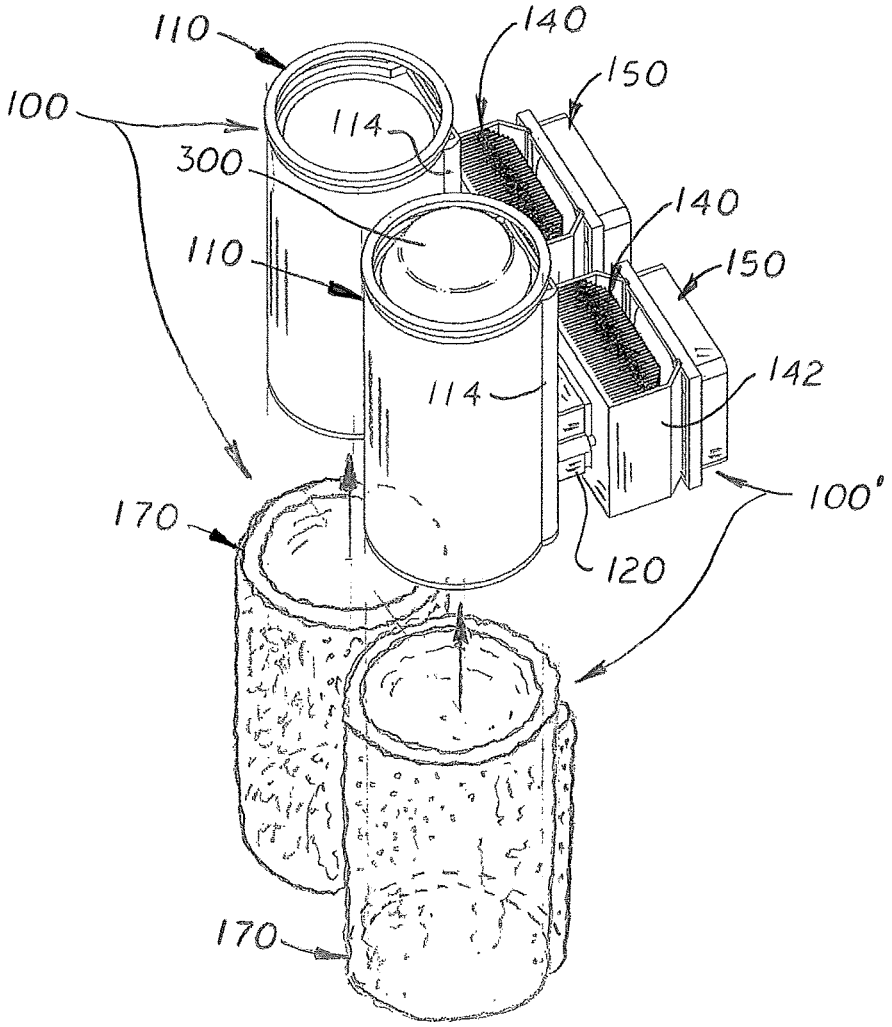
FIG. 16 is a perspective view of two heat conduction units showing the insulation covers placed around each cylindrical sleeve.

The mounting surface 114 varies in thickness. At its thinnest location it measures approximately 0.16 inches thick. In the embodiment in the FIG. 16, the mounting surface 114 extends the entire length of the cylindrical sleeve 110 and is made of the same material as the cylindrical sleeve 110. The mounting surface 114 is approximately 1.5 to 2 inches wide. The outer surface of the mounting surface 114 is flat and configured to press tightly against the inside surface of the interface block 120 that extends laterally from the cylindrical sleeve 110. Threaded bores are formed on the mounting surface 114 that received threaded connectors that extend through the interface block 120 to securely attach the interface block 120 to the cylindrical sleeve 110.

Figure 21:
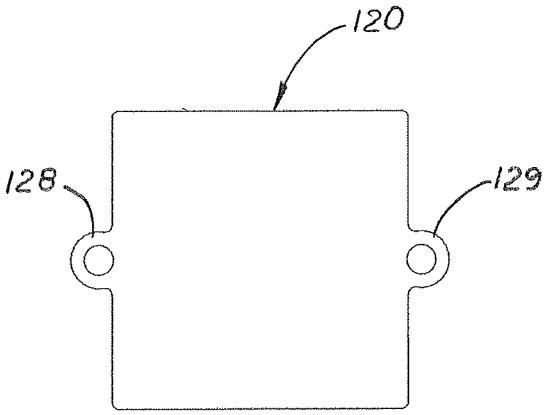
FIG. 21 is a rear elevational view of an interface block.

The interface block 120 is also made of aluminum a square or rectangular shaped box structure with two parallel flat ends 122, 124. The interface block 120 measures approximately 1.66 inches (w)×1.66 inches (h) and 0.8 inches thick (l). The interface block 120 includes two side ears 128, 129 as shown in FIG. 21 each with a bore that received threaded connectors 126 that connected to threaded bores 116 formed on the mounting surface 114 of the cylindrical sleeve 110. As shown in FIG. 19, bores may also be formed on the heatsink 140 enabling one pair of threaded connectors 126 to connect the interface block 120, the Peltier device 130 and the heatsink 140. The fan assembly 150 may include an optional frame 152 that snap fits over the heatsink 140.

Disposed around the cylindrical sleeve 110 and the interface block 120 is an insulation layer 170. In one embodiment, the insulation layer 17 is made of adhesive tap made of polyurethane which may be applied in tape form, spray foam, or a two part clamshell structure. The insulation layer 120 is configured to cover the entire cylindrical sleeve 110, the mounting surface 114 and the top, bottom and sides of the interface block 120.

Attached to the outside end 124 of the interface block 120 is a Peltier device 130. The Peltier device 130 is oriented so that the cold side 132 is aligned adjacent to the outside end 124. The opposite, or hot side 134 of the Peltier device 130 faces outward. In the embodiment described herein, the Peltier device 130 is a thermoelectric cooling plate manufactured by various manufactures available from Amazon.com. (Model No. TEC1-12703, 12 27W). It measures approximately 40 mm×40 mm×4 mm has an operating temperature between −55 degrees C. and +83 degrees C.

During operation, the Peltier device 130 depends heavily on the ambient temperature outside. If the Peltier device 130 is operated outdoors in a hot climate with ambient 100 degrees F. temperature, the Peltier unit 130 will struggle to cool the beverage can 300 or water bottle 302 to 60 degrees. Typical Peltier devices state the ability to lower the temperature approximately 40 degrees F. below the ambient air temperature. So this reason, a temperature readout has been eliminated. During operation, rotational LO to HIGH variable switch 76 is used for rough relative cooling set points. When the knob 76 is set to 'LO', this means the lowest voltage setting applied to the Peltier device 130. When set to LO, this means the highest voltage setting applied to Peltier device 130. The user is instructed to test the settings to determine the set point that cools or warms their beverage to their desired temperature.

A heatsink 140 is attached to the hot side of the Peltier device 130. The heatsink 140 fits inside an outer square shape frame 142 (see FIG. 16). Mounted over the outside surface of the heat-sink 140 is a D.C. 12 V volt fan assembly 150, (fan, blade and surrounding finger guard).

When the apparatus 10 is a beverage warmer, the current through the Peltier device 130 is reversed so the Peltier device 130 heats the aluminum interface block 120 and the cylindrical sleeve 110. The opposite side of the Peltier device 130 now cools the heatsink 140. The fan assembly 150 forces warm ambient air over the heatsink 140.

Figure 23:
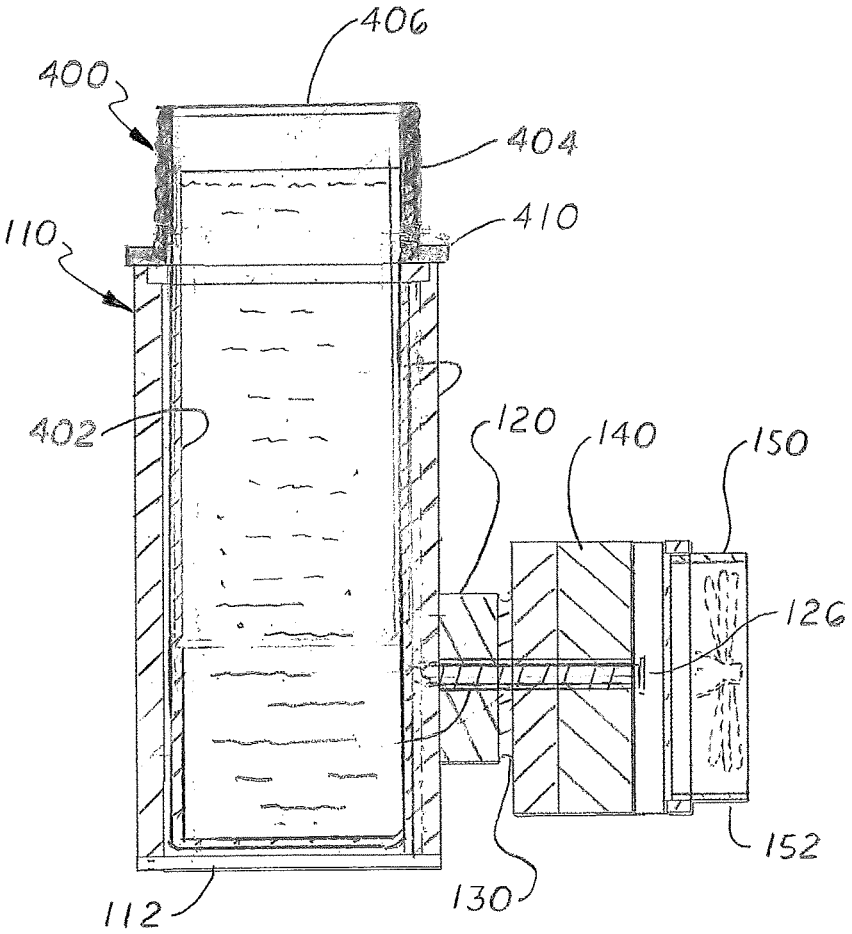
FIG. 23 is a sectional elevational view of one heat conduction unit with a secondary container placed inside the cylindrical sleeve and heated.
Figure 24:
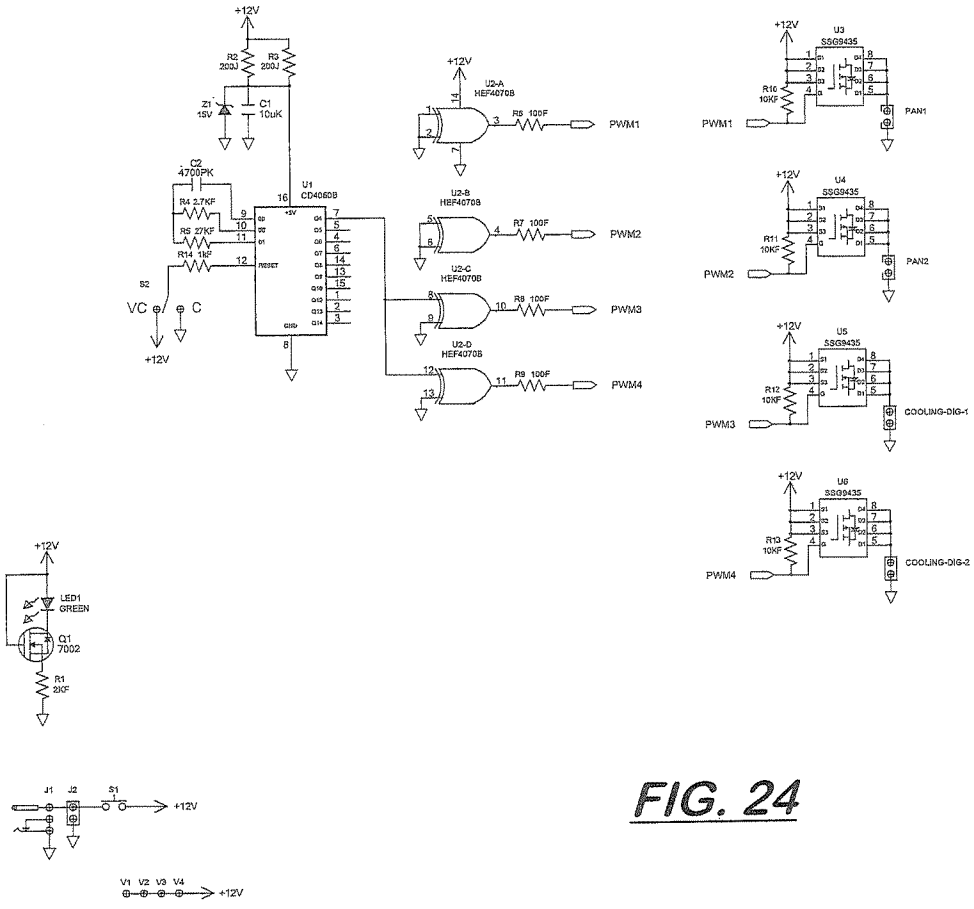
FIG. 24 is an electrical schematic drawing of the apparatus.

Also, when used as a beverage warmer, a cylindrical secondary container 400 is placed inside the cylindrical sleeve 110. The secondary container 400 include a lower cylindrical body 402 made of aluminum or similar heat conductive material. The outer diameter of the cylindrical body 402 is 1 to 2 mm less in diameter than the center bore 112. The lower cylindrical body 402 must also be made of heat resistant material that will not burn, melt or deform. Attached or formed on the body 402 is an upper cylindrical section 404 made of or covered by heat insulating material. In the embodiment shown in FIG. 23, a large diameter lower collar 410 is formed on the lower edge of the upper cylindrical section 404 which protects the user's hand against heated side walls of the cylindrical body 402. In the embodiment in FIG. 23, the length of the cylindrical body 402 is approximately the same length as the depth of the center bore 112 so the lower end of the cylindrical body 402 rests against in inside surface of the cylindrical sleeve 110. When the cylindrical section 402 is shorter than the cylindrical sleeve 110, the collar 410 acts as an abutment edge that prevents the second container 400 from falling into the center bore 112. In the embodiment shown in FIG. 23, an optional lid 406 is disposed over the upper portion 404 to prevent spills.

Figure 1:
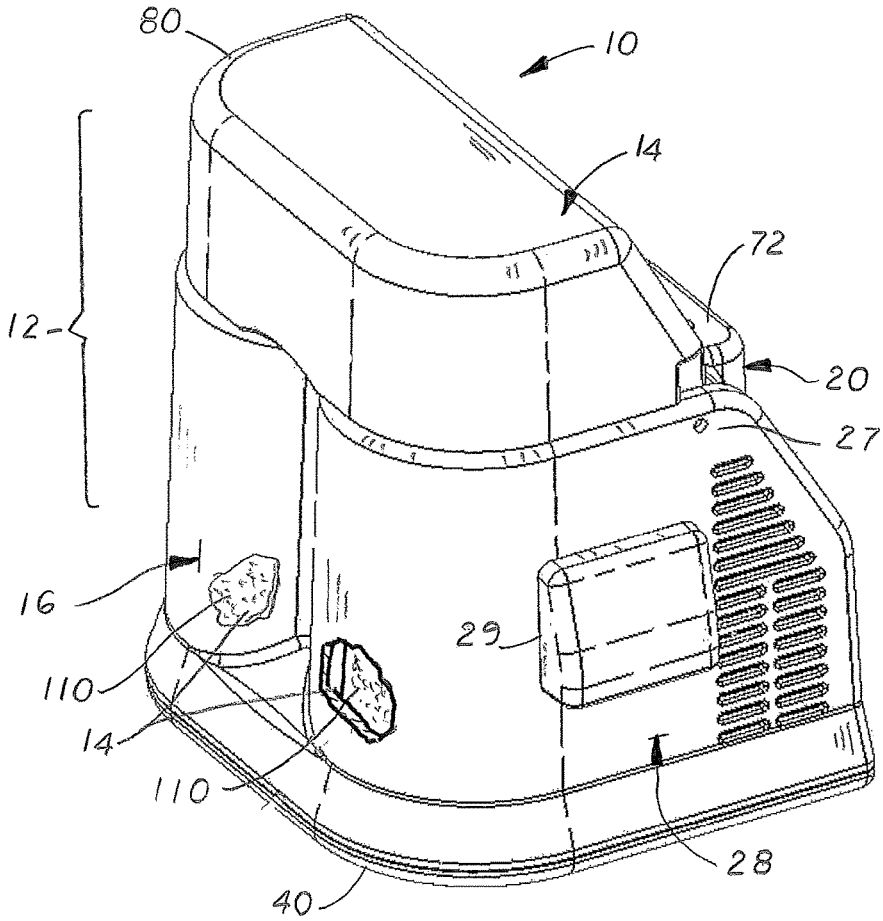
FIG. 1 is a front perspective view of the beverage cooler or warming apparatus.
Figure 2:
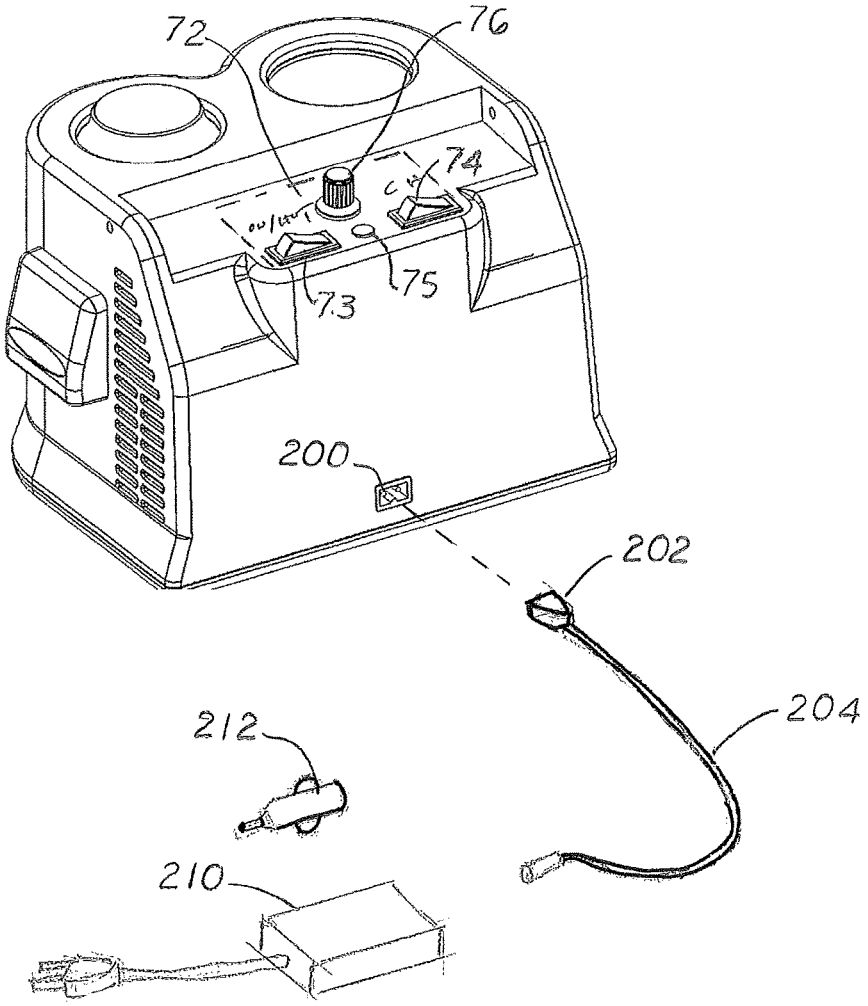
FIG. 2 is a rear perspective of the beverage cooler or warming apparatus with the lid removed.
Figure 3:
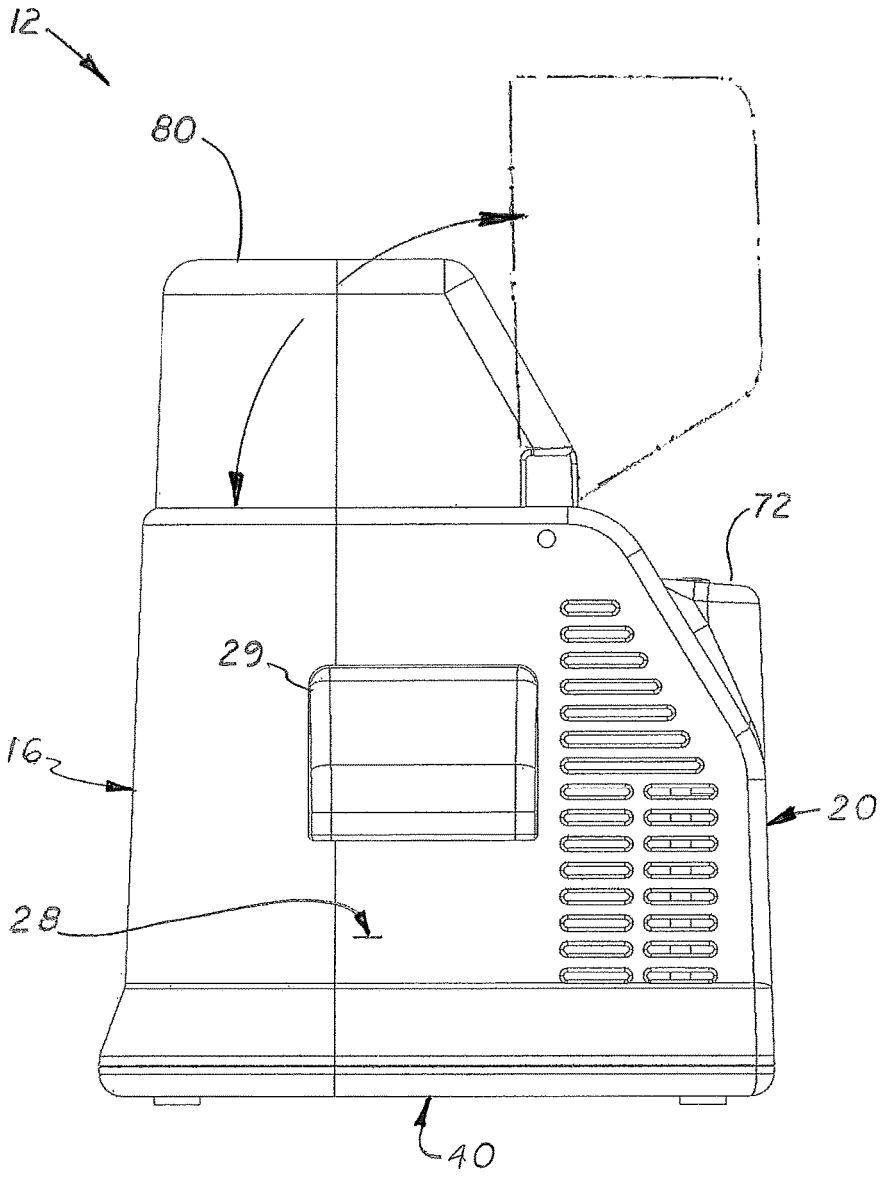
FIG. 3 is a left side elevational view of the apparatus shown in FIGS. 1-2 with the lid moving from a closed to an opened position.
Figure 4:
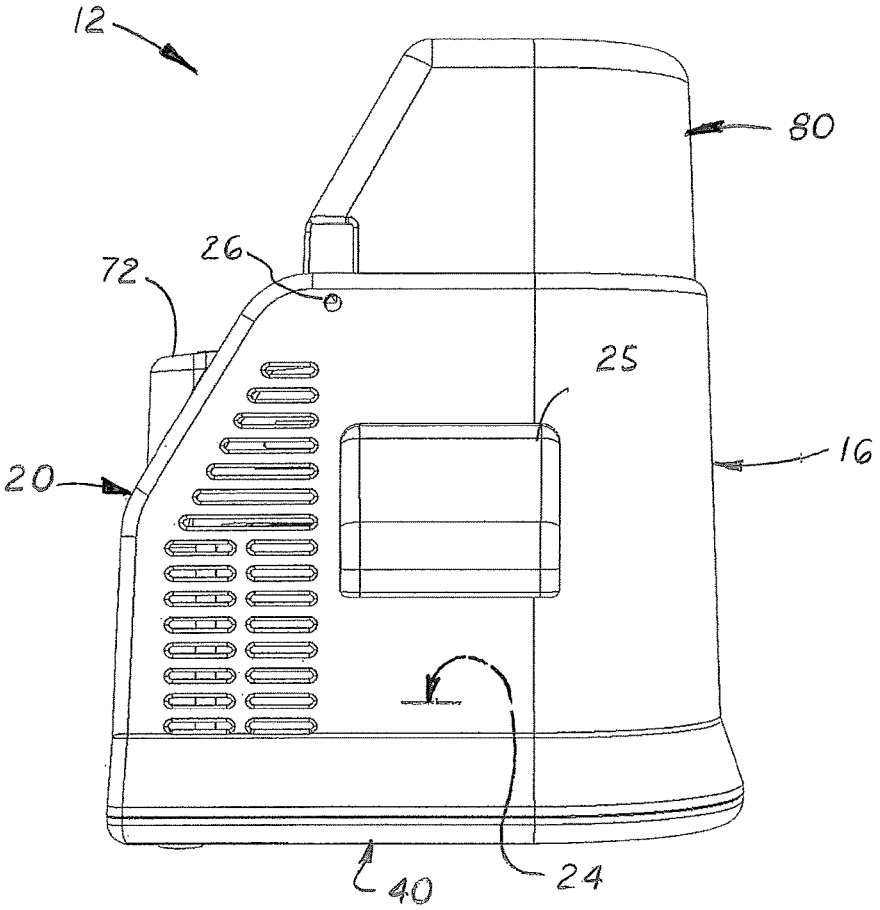
FIG. 4 is a right side elevational view of the apparatus shown in FIGS. 1-3 with the lid in a closed position.
Figure 5:
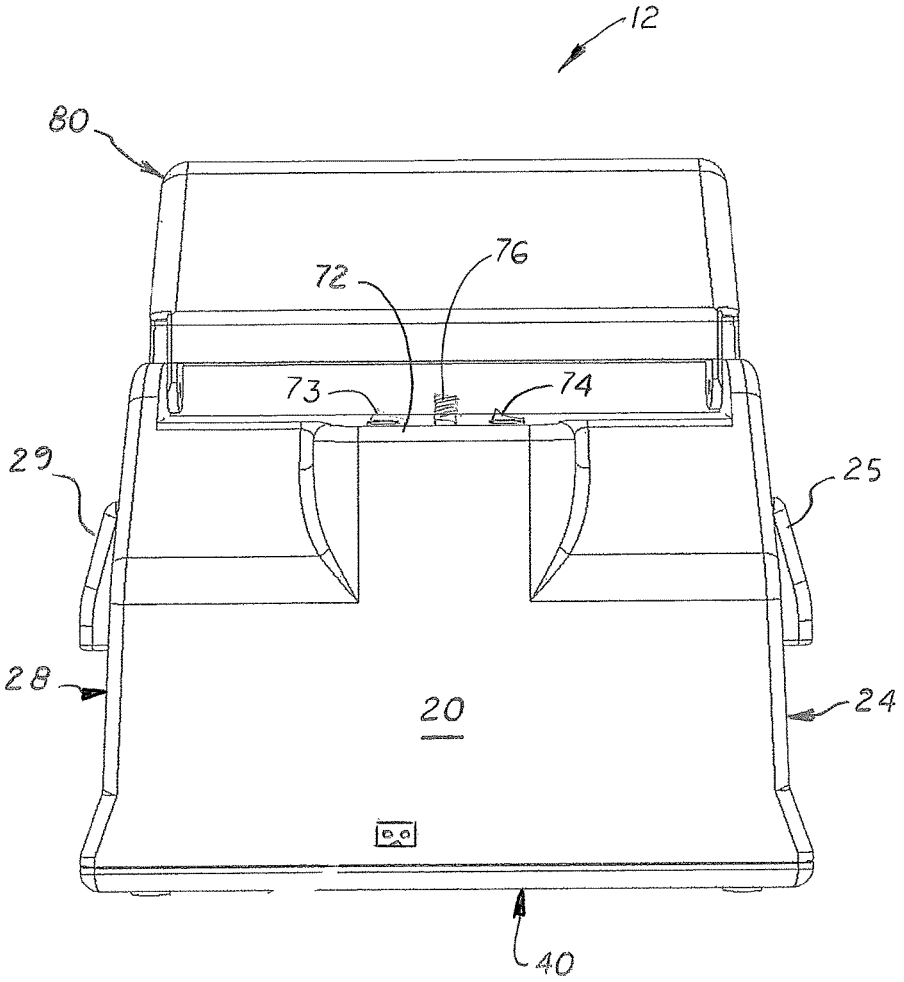
FIG. 5 is a rear elevational view of the apparatus.
Figure 6:
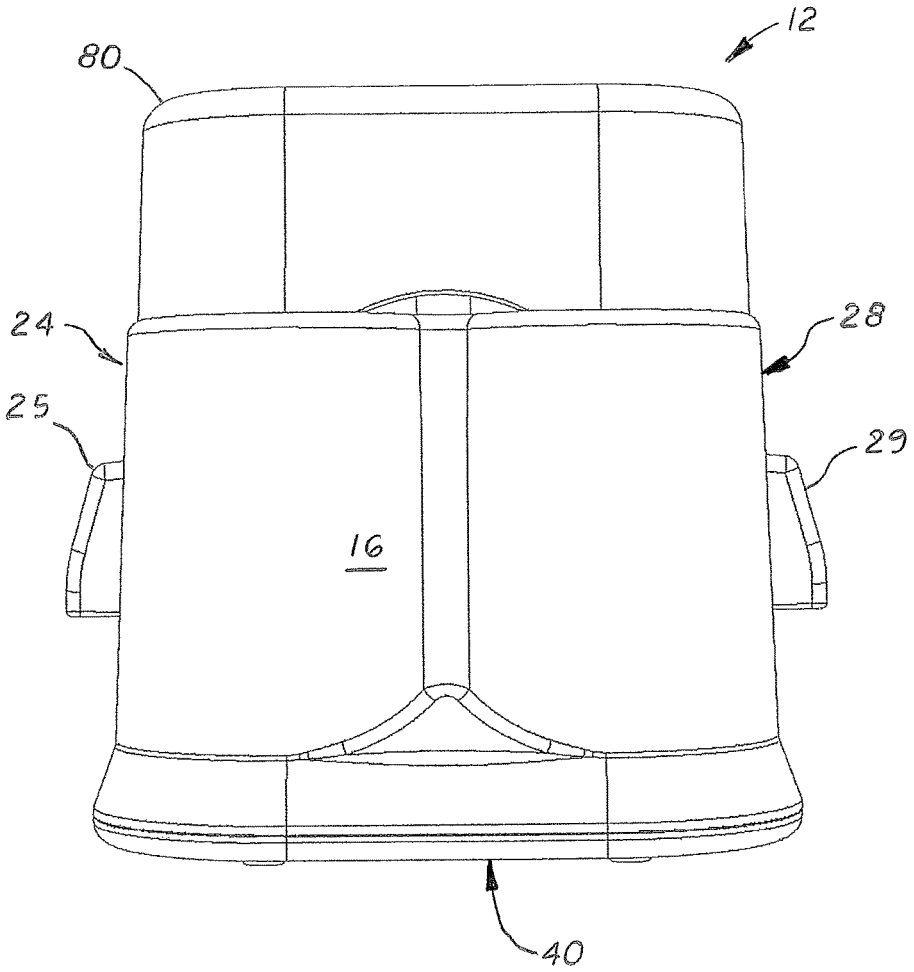
FIG. 6 is a front elevational view of the apparatus.
Figure 7:
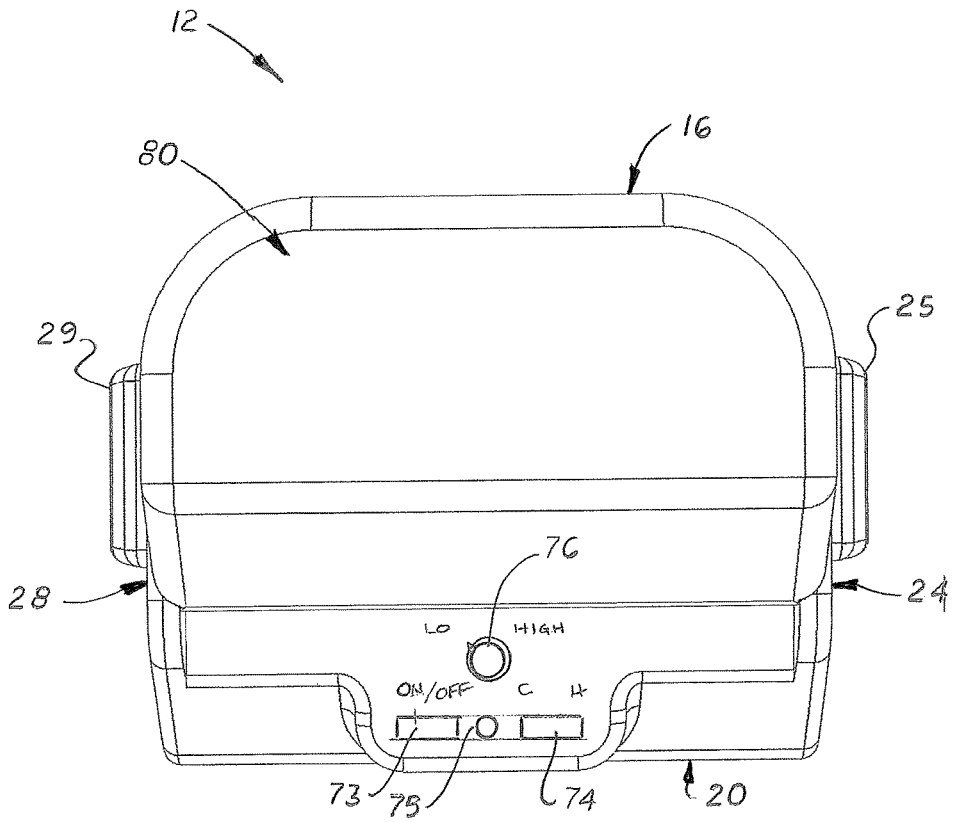
FIG. 7 is a top plan view of the apparatus.
Figure 8:
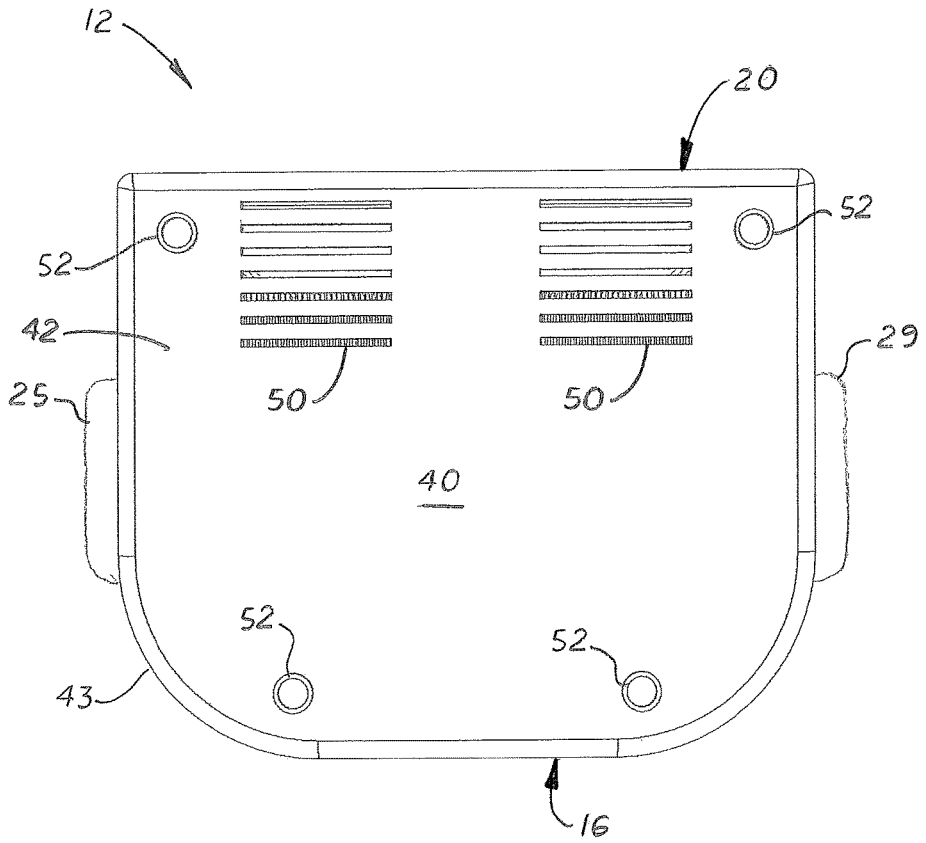
FIG. 8 is a bottom plan view of the apparatus.
Figure 9:
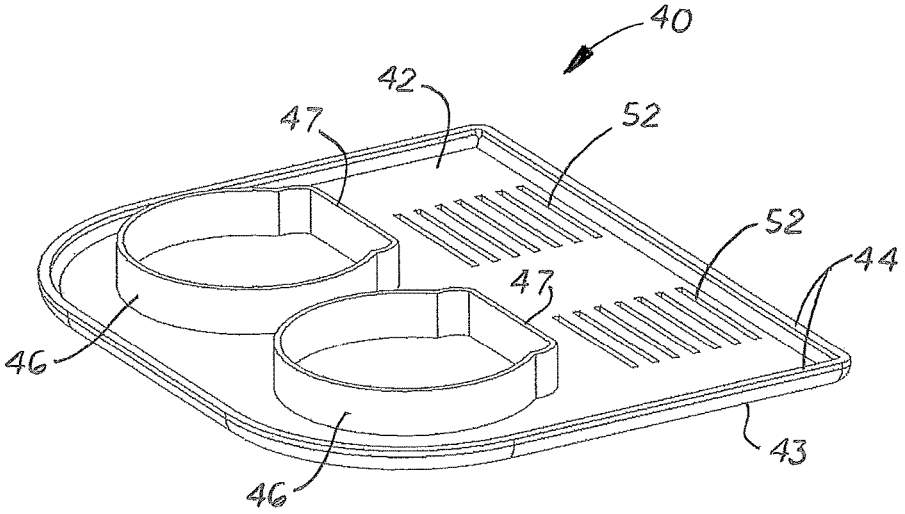
FIG. 9 is a perspective view of the base.

As shown in FIG. 4, mounted on the rear wall 20 of the case 12 is a female electrical plug connector 200 configured to connect to a complimentary-shaped male plug connector 202. The male plug connector 202 is attached to a wire 204 that connects either to a 110 VAC electrical power adaptor (also called a wall bug) 210 that converts 110 VAC to 12 VDC or to a motor vehicle cigarette plug adapter 212. Both adapters 210 and 212 are configured to provide the 8 Amps of current to power the two Peltier devices 130.

In the embodiment shown in the Figs. the apparatus 10 is a designed to be a portable, compact and used in a motor vehicle. The case 12 measures approximately 8"×7"×9". (W×D×L). In the embodiment presented in the Figs., the apparatus 10 include two side by side heat conducting units 100, 100'. It should be understood that the apparatus 10 may use one heat conducting unit 100 or more than two conducting units oriented in different configurations inside the case 12.

A key feature of the invention is the beverage coolers and warmers that used cool or hot air to cool or heat beverages are very inefficient and an improved beverage cooler and heater for beverages that used conduction is more efficient. Also, the discovery that 12 fl. oz. beverage aluminum cans 300 and 16.9 fl. oz plastic water bottles 302 have approximately the same diameter and therefore can be quickly cooled from room temperature (72 degrees F.) to refrigerator temperatures (sub 40 degrees) in 60 to 90 minutes a Peltier device assigned to each thermal conducting unit Because cooling and warming is through the Peltier device 130 to the interface block 120, and to the cylindrical sleeve 110 with a center bore 112 that 1 to 2 mm in diameter greater than the beverage container 300 or 310, changes to ambient air does not substantially affect the apparatus' cooling or heating properties. Any ambient air that enters the lid 80 has little or no effect on the temperature of the ambient air flowing inside the interior cavity and does not contact the cylindrical sleeves or the interface blocks. Also, because the length of the cylindrical sleeve 110 is limited to approximately 6 inches, the apparatus 10 is optimized for use with standard 12 fl. oz. aluminum cans and 16.9 fl. oz. water bottles.

In compliance with the statute, the invention described has been described in language more or less specific on structural features. It should be understood, however, that the invention is not limited to the specific features shown, since the means and construction shown comprises the preferred embodiments for putting the invention into effect. The invention is therefore claimed in its forms or modifications within the legitimate and valid scope of the amended claims, appropriately interpreted under the doctrine of equivalents.

I claim:

1. A portable beverage cooler or warmer apparatus, comprising:

a. a case with a front wall, a rear wall, two side walls, a top roof, a base, and an interior cavity, said top roof includes at least two sleeve openings that, said case includes air vents that allows ambient air to enter into said interior cavity;

b. two heat conduction units located inside said interior cavity, each of said two heat conduction units includes a cylindrical sleeve, an interface block, a Peltier device, a heatsink and a fan, each said cylindrical sleeve is made of aluminum and includes a lower mounting surface, a top opening and a center bore approximately 2.6 inches in diameter and approximately 6 inches in length, said interface block of each said two heat conduction units being mounted on said lower mounting surface on said cylindrical sleeve, said Peltier device of each said two heat conduction units being mounted on an end of said interface block opposite said cylindrical sleeve, said heat sink of each said two heat conduction units being mounted on a side of said Peltier device opposite said interface block, and said fan of each of said two heat conduction units being mounted on a side of said heat sink opposite said Peltier device, each said cylindrical sleeve being perpendicularly aligned on said base and axially aligned with one said sleeve opening of said two sleeve openings formed on said top roof;

c. an insulating polyurethane tape layer disposed around each said cylindrical sleeve and said interface block thereby insulating each said cylindrical sleeve from said ambient air that flows through said air vents and into said interior cavity;

d. an ON-OFF switch configured to activate or deactivate each of said two heat conduction units;

e. a cooling/warmer switch connected to each said Peltier device of said two heat conduction units to either cool or heat said cylindrical sleeve of each of said two conduction units, said cooling/warmer switch configured to change the operation of said Peltier device to either cool or heat said cylindrical sleeve;

f. an external D.C. volt electrical power source located outside said case and connected to said cooling/warmer switch, and g. a pivoting lid attached to said case and configured to cover said top roof.

2. The beverage cooler or warmer apparatus as recited in claim 1, wherein said polyurethane tape is adhesively attached to said cylinder sleeve of each of said two heat conduction units and said interface block of each of said two heat conduction units.

3. The beverage cooler or warmer apparatus as recited in claim 1, wherein said insulating polyurethane tape is approximately ½ inch thick.

4. The beverage cooler or warmer apparatus as recited in claim 1, further including a cylindrical receiver longitudinally aligned with each said cylindrical sleeve on said case when said pivoting lid is placed in a closed position over said case.

5. The beverage cooler or warmer apparatus as recited in claim 4, wherein each said cylindrical receiver includes a circular gasket configured to press against said cylinder sleeve with said pivoting lid is placed in a closed position over said case.

6. The beverage cooler or warmer apparatus as recited in claim 1, wherein said Peltier device is a thermoelectric plate that operates on 12 volts and operates on 3 Amperages.

* * * * *